US011950680B2

(12) United States Patent
Asmir

(10) Patent No.: US 11,950,680 B2
(45) Date of Patent: Apr. 9, 2024

(54) REFILLABLE BODY CARE OR COSMETIC STICK

(71) Applicant: Holy Pit GmbH, Graz (AT)

(72) Inventor: Samardzic Asmir, Vienna (AT)

(73) Assignee: Holy Pit GmbH, Graz (AT)

( * ) Notice: Subject to any disclaimer, the term of this patent is extended or adjusted under 35 U.S.C. 154(b) by 0 days.

(21) Appl. No.: 17/811,238

(22) Filed: Jul. 7, 2022

(65) Prior Publication Data

US 2023/0007918 A1 Jan. 12, 2023

(30) Foreign Application Priority Data

Jul. 8, 2021 (DE) ..... 20 2021 103 673.7

(51) Int. Cl.

| | |
|---|---|
| ***A45D 40/02*** | (2006.01) |
| ***A45D 40/00*** | (2006.01) |
| ***A45D 40/16*** | (2006.01) |
| ***A45D 40/20*** | (2006.01) |

(52) U.S. Cl.

CPC ..... *A45D 40/02* (2013.01); *A45D 40/16* (2013.01); *A45D 2040/0031* (2013.01); *A45D 2040/207* (2013.01)

(58) Field of Classification Search

CPC ..... A45D 40/02; A45D 40/16; A45D 2040/0031; A45D 40/20; A45D 2040/204; A45D 40/205; A45D 2040/207

USPC ..... 401/87, 88, 176, 179

See application file for complete search history.

(56) References Cited

U.S. PATENT DOCUMENTS

| | | | | |
|---|---|---|---|---|
| 1,850,934 | A | 3/1932 | Janer | |
| 4,580,920 | A | 4/1986 | Schmidt | |
| 4,621,935 | A | 11/1986 | Sussman | |
| 4,700,448 | A | 10/1987 | Parker | |
| 4,708,507 | A | 11/1987 | von Schuckmann | |
| 5,897,263 | A | 4/1999 | Fattori | |
| 5,944,434 | A * | 8/1999 | Schlatter | A45D 40/02 401/176 |
| 6,089,774 | A | 7/2000 | Franken et al. | |
| 6,817,799 | B1 | 11/2004 | Petit | |
| 8,348,534 | B1 * | 1/2013 | Brindise | B43K 23/016 401/6 |
| 2003/0108376 | A1 | 6/2003 | Hurlburt | |

(Continued)

FOREIGN PATENT DOCUMENTS

| | | |
|---|---|---|
| WO | 2015/020659 A1 | 2/2015 |
| WO | 2016/077459 A1 | 5/2016 |

(Continued)

OTHER PUBLICATIONS

Search Report issued in the United Kingdom Patent Application No. GB2210056.4, dated Feb. 22, 2023 in 7 pages.

(Continued)

*Primary Examiner* — David J Walczak

(74) *Attorney, Agent, or Firm* — Knobbe Martens Olson & Bear LLP

(57) ABSTRACT

A body care or cosmetic stick includes a body care or cosmetic mass arranged in an inner sleeve and the inner sleeve is arranged in an outer sleeve. The inner sleeve has a wall thickness in a range from 10 to 1200 μm. The inner sleeve can be configured for use as a refill unit for the body care or cosmetic stick.

12 Claims, 5 Drawing Sheets

(56) References Cited

U.S. PATENT DOCUMENTS

| | | | | |
|---|---|---|---|---|
| 2004/0071491 | A1* | 4/2004 | Hetzel | B43K 19/16 401/96 |
| 2004/0265033 | A1* | 12/2004 | Kurihara | A45D 40/06 401/68 |
| 2007/0160412 | A1 | 7/2007 | Cummings et al. | |
| 2018/0295968 | A1 | 10/2018 | Groffsky et al. | |
| 2019/0133298 | A1 | 5/2019 | Bushell | |

FOREIGN PATENT DOCUMENTS

| | | | |
|---|---|---|---|
| WO | 2021/030719 | A1 | 2/2021 |
| WO | 2021/089381 | A1 | 5/2021 |
| WO | 2021/108842 | A1 | 6/2021 |

OTHER PUBLICATIONS

Office Communication issued in the corresponding Austrian Patent Application No. 50103/2022, dated Sep. 4, 2023 in 6 pages including English translation.

Search Report issued in the corresponding Austrian Patent Application No. 50103/2022, dated Sep. 4, 2023 in 6 pages including English translation.

* cited by examiner

REFILLABLE BODY CARE OR COSMETIC STICK

CROSS-REFERENCE TO RELATED APPLICATION

This application claims priority to German Utility Model Application No. DE 20 2021 103673.7 filed on Jul. 8, 2021, the disclosure of which including the specification, the drawings, and the claims is hereby incorporated by reference in its entirety.

FIELD OF THE INVENTION

The invention pertains to a body care or cosmetic stick, wherein a body care or cosmetic mass is arranged in an inner sleeve and the inner sleeve is arranged in an outer sleeve, characterised in that the inner sleeve has a wall thickness in a range from 10 to 2000 μm, and the use of the inner sleeve.

BACKGROUND OF THE INVENTION

Body care or cosmetic sticks are used to allow a body care or cosmetic mass such as a deodorant mass, for example, to be applied to the armpit, for example, or to apply pigmented masses as a lipstick to lips.

Refillable body care or cosmetic sticks have already been known.

U.S. Pat. No. 4,621,935 describes a method for filling a cosmetic container with a push-up feature.

U.S. Pat. No. 4,700,448 describes a manufacturing method for manufacturing a deodorant stick with a push-up feature.

US 2003/0108376 A1 describes a deodorant stick with a feature for extending and retracting the deodorant mass.

U.S. Pat. No. 4,580,920 describes a deodorant stick.

WO 2016/077459 A1 describes an applicator for pharmaceutical compositions.

US 2007/0160412 A1 describes a push-up applicator for deodorants.

U.S. Pat. No. 4,708,507 describes a deodorant stick with a finger recess.

U.S. Pat. No. 5,897,263 describes a package for applying a deodorant.

U.S. Pat. No. 1,850,934 describes a lipstick package.

Many existing body care or cosmetic sticks are disadvantageous in that they are not refillable and thus generate a lot of waste. Existing refillable body care or cosmetic sticks are disadvantageous in that either the refill mechanism is very complicated or the refill package is harmful to the environment.

SUMMARY OF THE INVENTION

It is an object of the present invention to provide a body care or cosmetic stick that is refillable, has an easily customisable form of appearance and is environmentally friendly.

In a first embodiment, the object of the invention is achieved by a body care or cosmetic stick, wherein a body care or cosmetic mass is arranged in an inner sleeve and the inner sleeve is arranged in an outer sleeve, characterised in that the inner sleeve has a wall thickness in a range from 10 to 2000 μm.

Packaging materials for body care or cosmetic products must be certified or approved, respectively. Hence, this requires that the above-mentioned packagings lacking an inner sleeve must be approved for body care or cosmetic products. One advantage of the present invention is that the outer sleeve does not have to be approved for body care or cosmetic products, but only the inner sleeve which is made of paper, for example. This allows the use of different materials for the outer sleeve and a faster reaction on market requirements.

The fact that the body care or cosmetic stick of the present invention comprises an inner and an outer sleeve and the outer sleeve provides the actual protection of the product offers the possibility to make the inner sleeves of paper. This does not only give a cost advantage but, in comparison with most other products, it allows to manufacture a refill system for body care or cosmetic products such as deodorants where the deodorant is not packed in plastic material or aluminium but sustainably and environmentally-friendly in paper.

Preferably, a push-up mechanism is arranged in the outer sleeve or between the outer sleeve and the inner sleeve. Particularly preferably, no screw-up mechanism (a screw thread, for example) is provided in the inventive body care or cosmetic stick. This allows to push the body care or cosmetic mass in the inner sleeve with a finger from bottom to top, for example. The advantage over existing refill deodorant sticks is that most existing deodorant sticks are based on a screw-up package wherein the body care or cosmetic mass is dispensed from the package by turning. This system requires more individual parts, which leads to increased costs and space requirements, something the customers do not want. Hence, this allows to use thin paper tubes for the body care or cosmetic stick of the invention, for example, and to manufacture a much smaller and more convenient package without numerous individual parts. Thus, compared with a screw-up package, the body care or cosmetic stick according to the invention can be manufactured at a fraction of the cost.

Another advantage of the inner sleeve is that the outer sleeve does not have to comply with the various hygiene requirements since the outer sleeve does not contact the body care or cosmetic mass. The outer sleeve stays clean and is not soiled by the body care or cosmetic mass or body fluids.

Some refillable solutions of the prior art required the users to handle hot liquid deodorant compositions. This can lead to accidents. With the solution according to the invention this is not necessary.

Many of the refillable body care or cosmetic sticks of the prior art do not comprise an inner sleeve. Thus, these systems require a cleaning of the complete body care or cosmetic stick during refilling, which makes little sense from an economic perspective. In practice, the body care or cosmetic mass does not contact the outer sleeve due to the inner sleeve. Therefore, it is not necessary to clean the outer sleeve during refilling.

Body Care or Cosmetic Stick

The body care or cosmetic stick is preferably a deodorant stick or a lipstick.

Preferably, the body care or cosmetic stick is refillable. This is a very special advantage of this preferred embodiment.

Preferably, the inner sleeve and the outer sleeve can be easily separated from each other. This allows to sale and store the interior elements such as the inner sleeve independently of the outer sleeve. This also allows to combine different variants with each other in a cost-efficient way. Thus, the inner sleeve containing a particular deodorant composition can be combined with any outer sleeve.

The body care or cosmetic stick can have various shapes and cross-sections perpendicular to the longitudinal axis. Particularly preferably, the cross-section of the body care or cosmetic stick perpendicular to the longitudinal axis is circular and especially not oval. This has the advantage that the user can more easily insert the inner sleeve into the outer sleeve. This facilitates the handling by the user.

Preferably, the inventive body care or cosmetic stick does not have a threaded rod. Commonly, the threaded rod is connected to the outer housing and provides for the displacement of the body care or cosmetic mass. However, this usually prevents a replaceable inner sleeve which is especially preferred.

Preferably, the inventive body care or cosmetic stick does not have a sieve. This has the advantage that the composition of the body care or cosmetic mass is not limited.

Preferably, the inventive body care or cosmetic stick does not have a sponge. This has the advantage that the body care or cosmetic mass does not need to be fluid.

Preferably, the minimum distance between the inner surface of the outer sleeve and the body care or cosmetic mass is in a range from 0.1 to 30 mm, especially from 0.5 to 5 mm, very particularly preferably in a range from 3 to 10 mm.

In the prior art, the body care or cosmetic mass must often be filled in and cured when upside down. As a result, the body care or cosmetic mass can adhere directly to the cap or the outer sleeve, respectively. The inner sleeves according to the invention can be filled upright. Thus, the inventive body care or cosmetic mass does not adhere to the cap or the outer sleeve, respectively. Due to the distance between the outer sleeve and the body care or cosmetic mass the body care or cosmetic mass can always stand out a little from the opened outer sleeve without being pushed in by the outer sleeve during closing. This is often not possible in the prior art since the mass is filled into the cap or the outer sleeve already during the filling process.

Preferably, no screw thread is provided in the inventive body care or cosmetic stick. Alternatively, the central part and the lower part can be screwed together. Alternatively, the cap and the central part can be screwed together.

Preferably, the weight of the outer sleeve is lower than the weight of the inner sleeve with the body care or cosmetic mass. This has the advantage that, for example, the replaceable inner sleeve with the body care or cosmetic mass predominates and the body care or cosmetic stick is therefore more environmentally friendly.

The volume enclosed by the outer sleeve is preferably in a range from 50 to 250 $cm^3$.

The volume of the body care or cosmetic mass is preferably in a range from 10 to 75 $cm^3$.

The volume ratio between the volume of the body care or cosmetic mass and the volume enclosed by the outer sleeve is preferably in a range from 0.1 to 0.7, especially preferably in a range from 0.2 to 0.5. Hence, the body care or cosmetic stick according to the invention is especially space-efficient.

Body Care or Cosmetic Mass

The body care or cosmetic mass is preferably solid, very particularly preferably waxy. The melting point of the body care or cosmetic mass is preferably in a range from 35 to 50° C.

The body care or cosmetic mass is preferably a deodorant mass.

Preferably, at least 60% of the surface of the body care or cosmetic mass is covered by the inner sleeve.

Preferably, the body care or cosmetic mass is not fluid or gel-like. Preferably, the body care or cosmetic mass is solid and/or dimensionally stable.

Preferably, the body care or cosmetic stick is cylindrical. The cylinder has a circumferential surface (or also cylinder wall) and two bases (or also base areas), for example. Preferably, most of the cylinder wall of the body care or cosmetic mass is covered by the inner sleeve.

Inner Sleeve

The inner sleeve preferably mainly consists of a material selected from paper, cardboard, film and/or mixtures containing these materials, very particularly preferably mainly of cellulose, paper, cardboard and/or mixtures containing these materials. This makes the consumable component of the inventive body care or cosmetic stick especially environmentally friendly and sustainable.

The inner sleeve is preferably made of another material than the outer sleeve.

The inner sleeve is preferably cylindrical. At one end of the cylinder, the inner sleeve is preferably open. At the other end of the cylinder a bottom is contemplated. The bottom is arranged, especially preferably clamped in the cylinder wall. The cylinder wall has preferably a wall thickness in a range from 10 to 1200 μm, more preferably 100 to 900 μm, especially preferably in a range from 300 to 800 μm, very particularly preferably in a range from 400 to 700 μm.

Especially preferably, the cylinder wall consists preferably mainly, especially preferably completely, of a material selected from cellulose, paper, cardboard, film and/or mixtures containing these materials. Especially preferably, the cylinder wall of the inner sleeve consists of paper.

The outer surface of the inner sleeve and in particular the outer surface of the cylinder wall of the inner sleeve is preferably not patterned such that it interacts with a structure of the inner surface of the outer sleeve. Especially preferably, this outer surface is not patterned, and in particular it is smooth. This allows to manufacture it at low cost.

Preferably, the inner sleeve is constructed in two parts. In particular, the inner sleeve preferably comprises a cylinder wall and a bottom separable therefrom. Preferably, the bottom is clamped in the cylinder wall.

The bottom consists preferably mainly, especially preferably completely, of cellulose, paper, cardboard and/or mixtures containing these materials.

Preferably, the inner sleeve can be inserted into the outer sleeve. Preferably, the bottom is configured as a slider.

At one end of the sleeve the inner sleeve is open, for example. In comparison with the rest of the sleeve, this open end of the inner sleeve is preferably not tapered. Hence, in the manufacture of the inner sleeve with the body care or cosmetic mass contained therein, the liquid does not have to flow through a small opening as in the prior art. This provides the advantage that the body care or cosmetic mass can easily be portioned and filled in almost every filling line without major modifications. This reduces machine processing times. Thus, the mass also does not have to be liquid enough to be injectable through a taper into the sleeve, and the body care or cosmetic mass can also be filled at lower temperatures. This is an advantage in the manufacture which has a positive effect on cost.

The inner sleeve is preferably not elastic, that is, it does not return to its original shape when deformed.

Preferably, the inner sleeve is replaceable. This has the advantage that less waste is produced and the inventive body care or cosmetic stick is more environmentally friendly.

Outer Sleeve

The outer sleeve is preferably formed in multiple parts, very particularly preferably in three parts. The outer sleeve preferably comprises a cap, a central part and/or a lower part. The inner sleeve is preferably supported by the central part and/or the lower part. The inner sleeve can be clamped in the central part, for example. To this end, clamping projections for clamping the inner sleeve are arranged on the inner wall of the outer sleeve or the central part. These clamping projections are preferably located in the upper half of the inner wall of the outer sleeve or the central part. Alternatively, the outer sleeve can also be threadably connected to the central part.

The central part can be releasably clamped to the cap. The central part can be releasably clamped to the lower part. This has the advantage that the inner sleeve can be easily replaced.

Preferably, the outer sleeve or the lower part, respectively, has a recess at the bottom. The user can insert a finger through the recess for pushing the body care or cosmetic mass upwards with the finger.

The outer sleeve or the central part, respectively, can have a recess at the upper end. This allows the body care or cosmetic mass to exit at the top of the outer sleeve or the central part, respectively. Preferably, this recess has an edge forming the top edge of the outer sleeve or the central part, respectively.

Preferably, the outer sleeve surrounds the inner sleeve and the body care or cosmetic mass such that the body care or cosmetic mass is completely covered from the outside by the inner and/or outer sleeve in the closed state of the outer sleeve.

Preferably, the outer sleeve has a stiffness that prevents it from being deformed under normal finger force. This has the advantage that the inner sleeve can be made of a relatively thin and less rigid material and that the body care or cosmetic mass is not deformed or unintentionally squeezed out of the inner sleeve by an (unintentional) deformation of the outer sleeve.

Preferably, the inner sleeve outer top edge has a larger diameter than the inner top edge of the outer sleeve and/or the central part. Preferably, the diameter of the inner sleeve inner top edge differs from the diameter of the outer sleeve inner top edge by less than 1 mm, especially by less than 500 μm. This has the advantage that the body care or cosmetic mass contained in the inner sleeve can exit from the upper opening of the outer sleeve or the central part, respectively, while the inner sleeve is retained in the outer sleeve.

For example, the body care or cosmetic stick according to the invention has a bottom on which the body care or cosmetic mass is arranged and which is not connected to the outer sleeve.

In another embodiment, the object of the invention is achieved by the use of an inner sleeve with a body care or cosmetic mass arranged therein as a refill unit for an outer sleeve which then forms a body care or cosmetic stick together with the inner sleeve containing the body care or cosmetic mass.

BRIEF DESCRIPTION OF THE DRAWINGS

Further practical embodiments and advantages of the invention are described below in conjunction with the drawings. In the drawings.

DETAILED DESCRIPTION OF THE PREFERRED EMBODIMENTS

Figure 1:
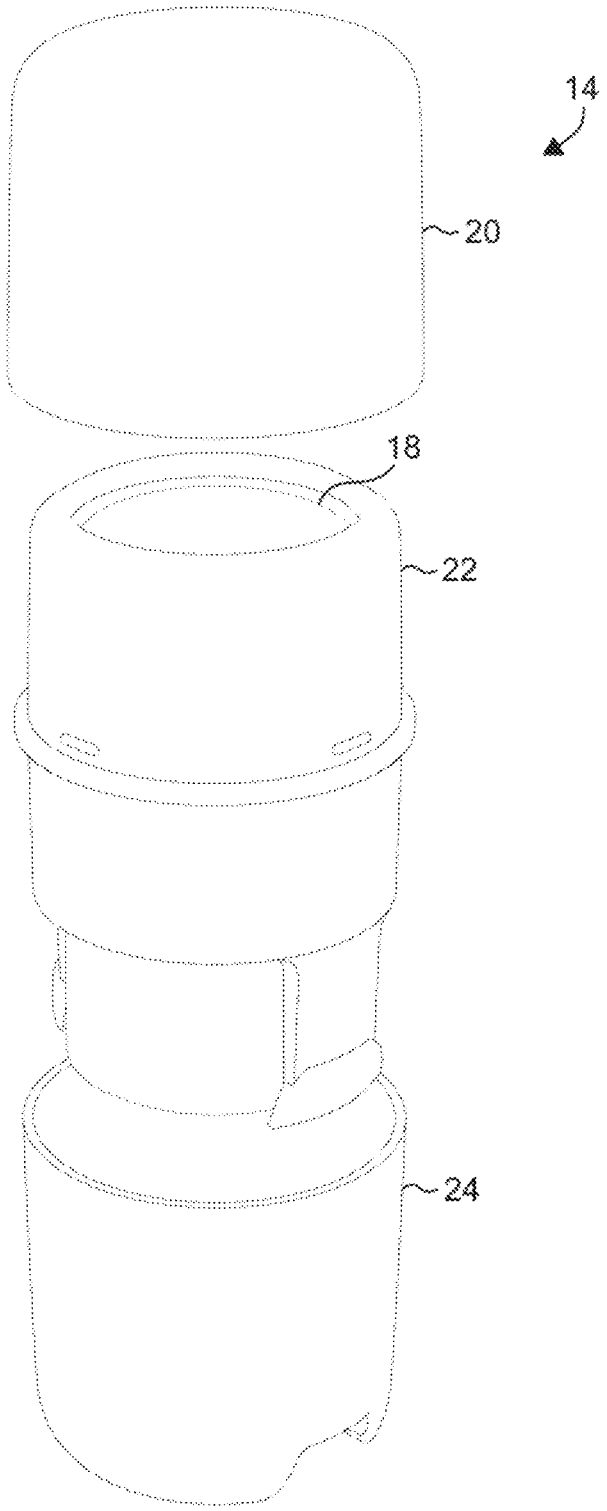
FIG. 1 shows an exploded view of the three-part outer sleeve with a cap, a central part and a lower part.
Figure 2:
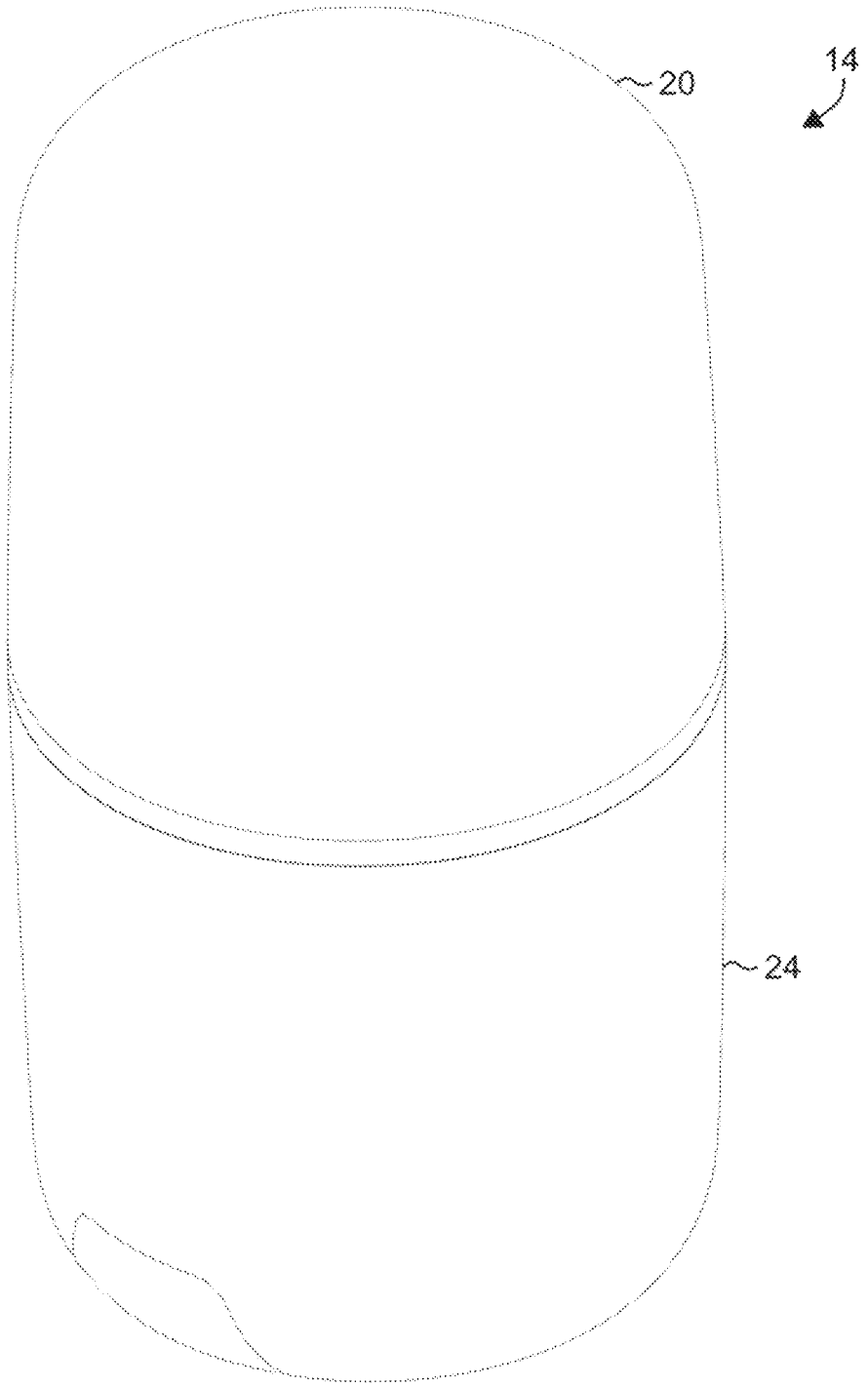
FIG. 2 shows the outer sleeve in a closed and assembled state.
Figure 3:
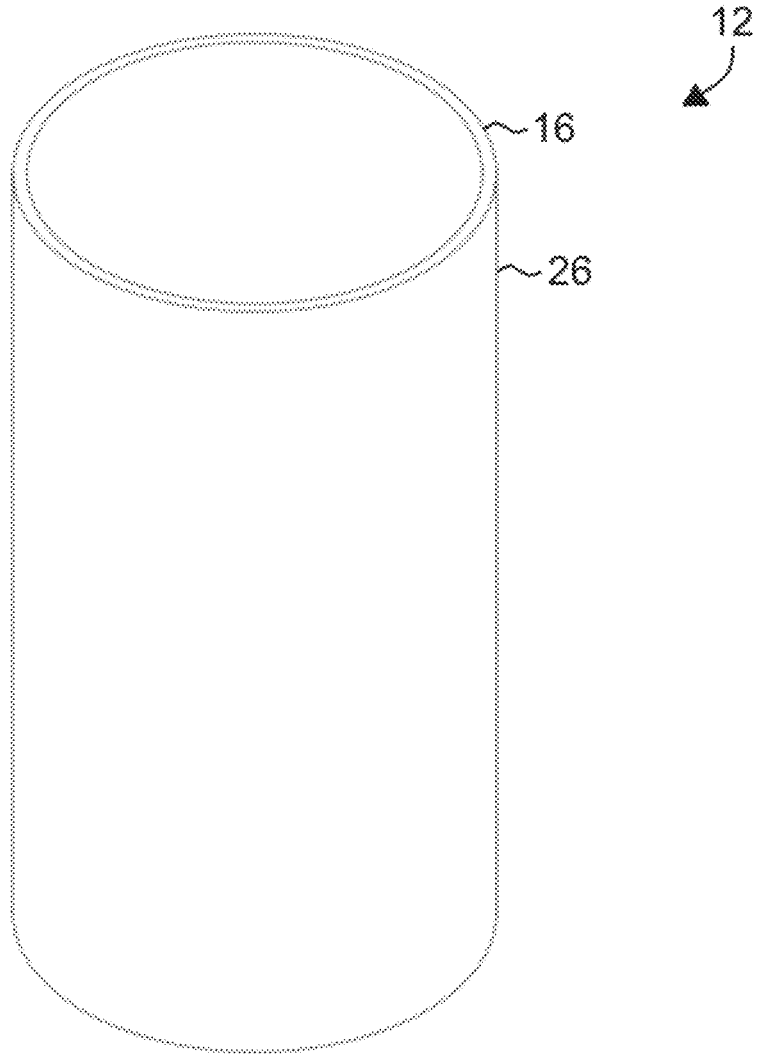
FIG. 3 shows the inner sleeve.
Figure 4:
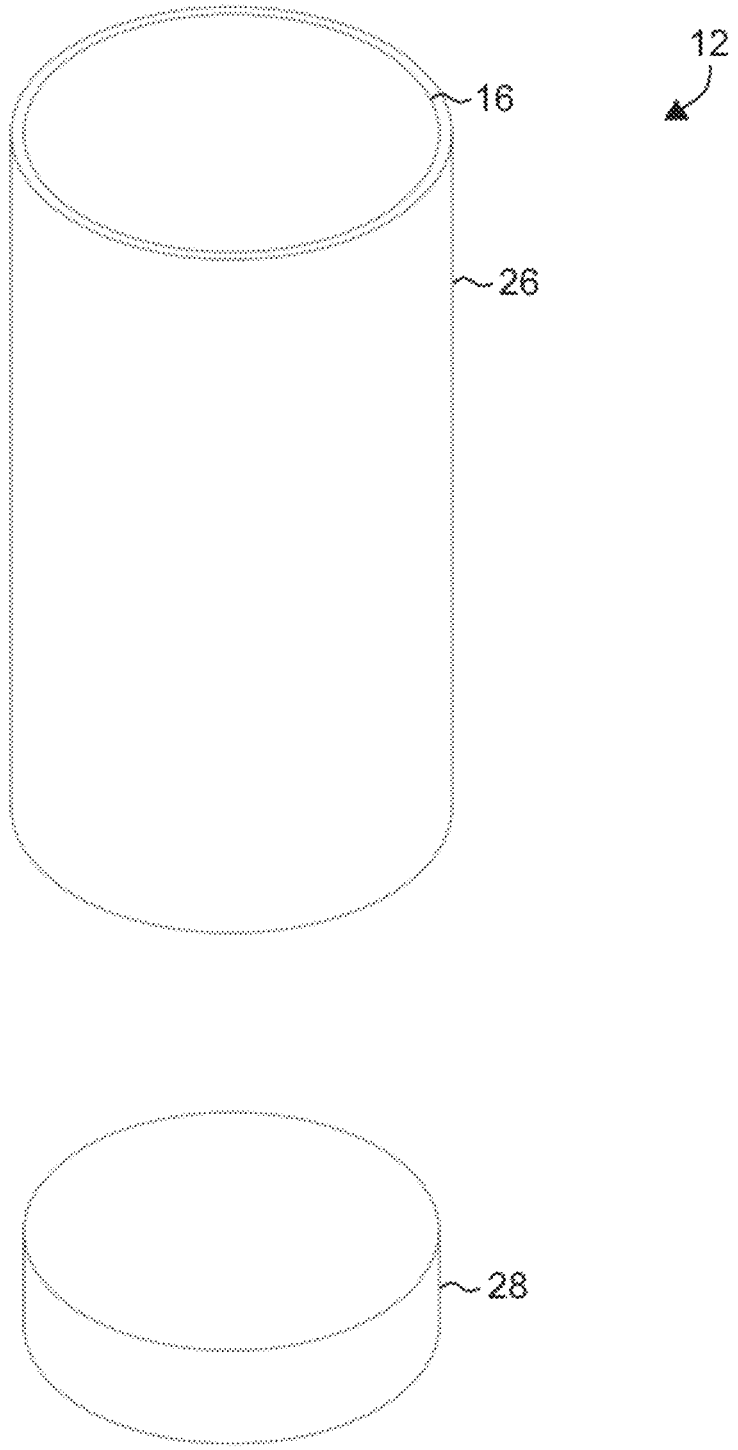
FIG. 4 shows an exploded view of the inner sleeve showing the bottom that can be clamped in the bottom of the cylinder wall.
Figure 5:
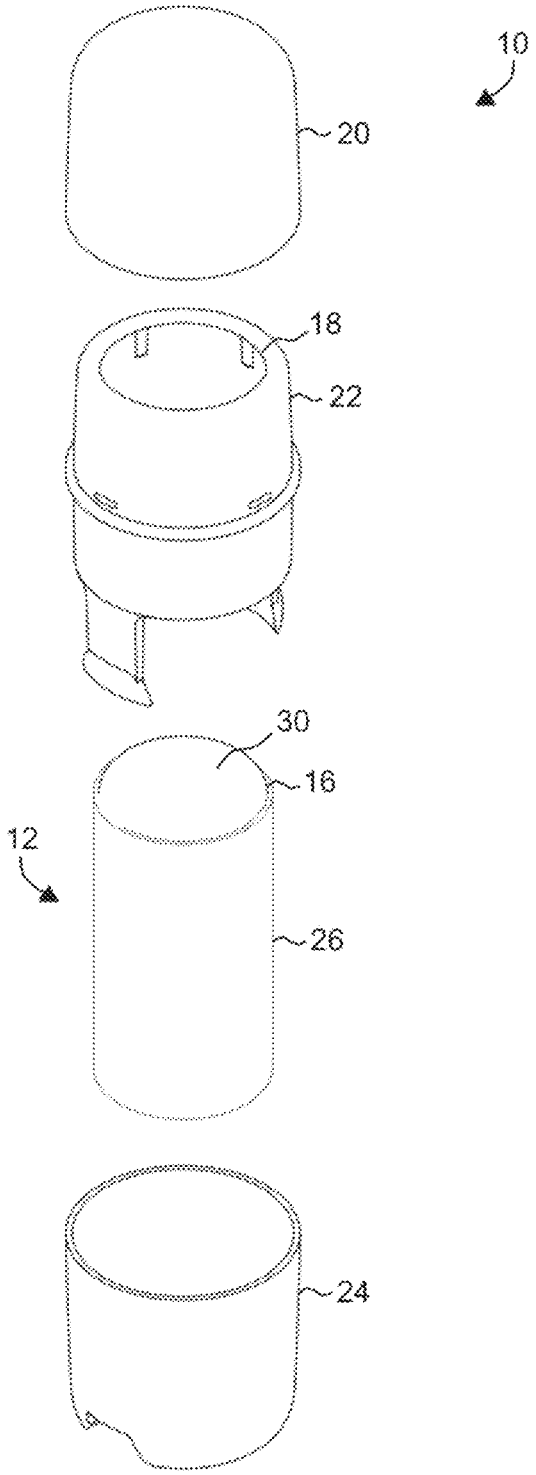
FIG. 5 shows an exploded view of the three-part outer sleeve and the inner sleeve with the body care or cosmetic mass.

The body care or cosmetic stick 10 comprises an inner sleeve 12 and an outer sleeve 14, wherein the inner sleeve 12 can be inserted into the outer sleeve 14 from below, for example. The outer sleeve 14 can be made of three parts and comprise a cap 20, a central part 22 and a lower part 24 (cf. FIG. 1). These three parts can be sticked together and then form the outer sleeve 14 as shown in FIG. 2. The inner sleeve 12 can be a cylindrical paper sleeve wherein a circular cardboard bottom 28 can be clamped in at the bottom of the cylinder wall 26 (cf. FIGS. 3 and 4). The inner sleeve can then be filled with the body care or cosmetic mass 30 and inserted into the outer sleeve 14 and clamped there, as shown in FIG. 5. Thus, the inner sleeve outer top edge 16 can be slightly broader than the outer sleeve inner top edge 18 to prevent the inner sleeve 12 from being pushed out of the outer sleeve 14 when the user pushes against the bottom 28 with a finger from below to press the body care or cosmetic mass 30 upwards within the inner sleeve 12.

The features of the invention disclosed in the present description, in the drawings as well as in the claims both individually and in any combination may be essential to the realisation of the various embodiments of the invention. The invention is not limited to the described embodiments. It may be varied to the extent as falls into the scope of the invention, taking into account the knowledge of one skilled in the art.

REFERENCE SYMBOLS LIST

1 Body care or cosmetic stick
12 Inner sleeve
14 Outer sleeve
16 Inner sleeve outer top edge
18 Outer sleeve inner top edge
20 Cap
22 Central part
24 Lower part
26 Cylinder wall
28 Bottom
30 Body care or cosmetic mass

What is claimed is:

1. A body care or cosmetic stick comprising:
a body care or cosmetic mass,
an inner sleeve, and
an outer sleeve,
wherein the body care or cosmetic mass is arranged in the inner sleeve and the inner sleeve is arranged in the outer sleeve and the inner sleeve has a wall thickness in a range from 10 to 2000 μm,
wherein an inner sleeve outer top edge has a larger diameter than an outer sleeve inner top edge,
wherein the inner sleeve outer top edge has a larger diameter than a central part inner top edge, and
wherein the body care or cosmetic mass in the inner sleeve is not fluid or gel-like and is configured to be pushed without a screw-up mechanism.

2. The body care or cosmetic stick according to claim 1, wherein the body care or cosmetic stick is refillable.

3. The body care or cosmetic stick according to claim 1, wherein the inner sleeve comprises a material selected from cellulose, paper, cardboard and/or mixtures containing said materials.

4. The body care or cosmetic stick according to claim 1, wherein the outer sleeve is formed in three parts.

5. The body care or cosmetic stick according to claim 4, wherein the outer sleeve comprises a cap, a central part and a lower part.

6. The body care or cosmetic stick according to claim 1, wherein the inner sleeve is cylindrical.

7. The body care or cosmetic stick according to claim 6, wherein a cylinder wall has a wall thickness in a range from 400 to 700 μm.

8. The body care or cosmetic stick according to claim 1, wherein the inner sleeve is replaceable.

9. The body care or cosmetic stick according to claim 1, wherein the inner sleeve is made of a different material than the outer sleeve.

10. A kit comprising a refill unit for the body care or cosmetic stick according to claim 1 comprising the inner sleeve with the body care or cosmetic mass arranged therein.

11. The body care or cosmetic stick according to claim 1, wherein the inner sleeve is cylindrical.

12. The body care or cosmetic stick according to claim 11, wherein a bottom is clamped in a cylinder wall at one end of the inner sleeve.

* * * * *